US008352064B2

(12) United States Patent
Schenk et al.

(10) Patent No.: US 8,352,064 B2
(45) Date of Patent: Jan. 8, 2013

(54) REVERT BLEND ALGORITHM AND APPARATUS USING THE ALGORITHM

(75) Inventors: Dale A. Schenk, Glastonbury, CT (US); John J. Schirra, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 2 days.

(21) Appl. No.: 13/079,857

(22) Filed: Apr. 5, 2011

(65) Prior Publication Data

US 2012/0095590 A1 Apr. 19, 2012

Related U.S. Application Data

(62) Division of application No. 12/252,754, filed on Oct. 16, 2008, now abandoned.

(51) Int. Cl.

| | |
|---|---|
| ***G06F 19/00*** | (2011.01) |
| *B22F 9/00* | (2006.01) |
| *C21C 1/06* | (2006.01) |
| *C22B 1/06* | (2006.01) |
| *C22B 1/00* | (2006.01) |
| *C22C 1/06* | (2006.01) |

(52) U.S. Cl. ..... 700/145; 75/246; 75/330; 75/401

(58) Field of Classification Search ..... 75/246, 75/330, 401; 700/145

See application file for complete search history.

(56) References Cited

U.S. PATENT DOCUMENTS

| | | | |
|---|---|---|---|
| 5,693,159 | A | 12/1997 | Athey et al. |
| 5,922,148 | A | 7/1999 | Irvine et al. |
| 6,571,857 | B2 | 6/2003 | Darolia et al. |
| 7,329,382 | B2 | 2/2008 | Amick |
| 7,381,366 | B2 | 6/2008 | Carter, Jr. et al. |

*Primary Examiner* — Stuart Hendrickson
*Assistant Examiner* — Alexander Polyansky
(74) *Attorney, Agent, or Firm* — Kinney & Lange, P.A.

(57) ABSTRACT

A revert alloy is used in the manufacture of a target alloy having a different composition. The weight percent of the elemental constituents of this first alloy and a second or target alloy are obtained, and the ratio of the percentage by weight of each elemental constituent in the first alloy to the second alloy is determined. The lowest ratio is used to determine the amount of the first alloy that is melted and the necessary elemental constituents that are added to the melt to produce the desired composition of the target alloy. The melt is solidified to produce the target alloy.

6 Claims, 3 Drawing Sheets

REVERT BLEND ALGORITHM AND APPARATUS USING THE ALGORITHM

CROSS-REFERENCE TO RELATED APPLICATION(S)

This application is a divisional of application Ser. No. 12/252,754, filed on Oct. 16, 2008. All references are incorporated herein.

BACKGROUND

The present invention relates to converting one metal alloy to another alloy composition. More particularly, the invention relates to converting scrap alloys into a different or target alloy for use as a new material.

Often there is a greater amount of used or scrap alloy of one formulation or composition than of other alloy compositions that are used for other purposes. This difference in the quantity of scrap alloys may be caused, for example, by more of one alloy being sent to scrap than from another alloy. Other times, improved alloys are developed and the prior alloy composition is no longer used or used in lower quantity. Those scrap alloys have, in the past, not been readily reusable. Having the ability to use any scrap alloy to produce other alloys also reduces the number of different alloys needed in inventory, When parts made of an alloy such as a nickel or cobalt superalloy used in turbine blades are taken out of service after the prescribed period of use, thus becoming what is known as "revert" alloy pieces, processes are used to reclaim those alloys because, in some cases, the alloys contain valuable elemental constituents such as rhenium. Even when small amounts of rhenium are used, the material cost of this element can have a major impact on the total cost of the alloy.

SUMMARY

The present invention is a method and system for using a first or revert alloy having a first composition, in the manufacture of a second or target alloy having a different composition. The first alloy is cleaned and prepared for melting.

The weight percent of the elemental constituents of this first alloy and a second target alloy are obtained, e.g., from records maintained by the alloy manufacturer. The ratio of the percentage by weight of each elemental constituent in the first alloy to the second alloy is determined. The lowest ratio of the respective constituents then determines the amount of the first alloy that can be used. The first alloy is then melted and the necessary elemental constituents including aluminum are then to achieve the composition of the second alloy. The resulting second alloy is then solidified.

DETAILED DESCRIPTION

In the past, service revert materials have not been utilized in making the same or new alloys because of concerns regarding cleanliness of the used casting. Careful cleaning, using strong cleaning methods, to remove sufficient contaminants has made such reuse practical. Use of grit blasting and/or a high strength alkali or an autoclave to clean a scrap part, followed by an acid treatment renders the part fit for re-use. The part is melted to produce ingot for later re-melting and use in this invention.

Figure 1:
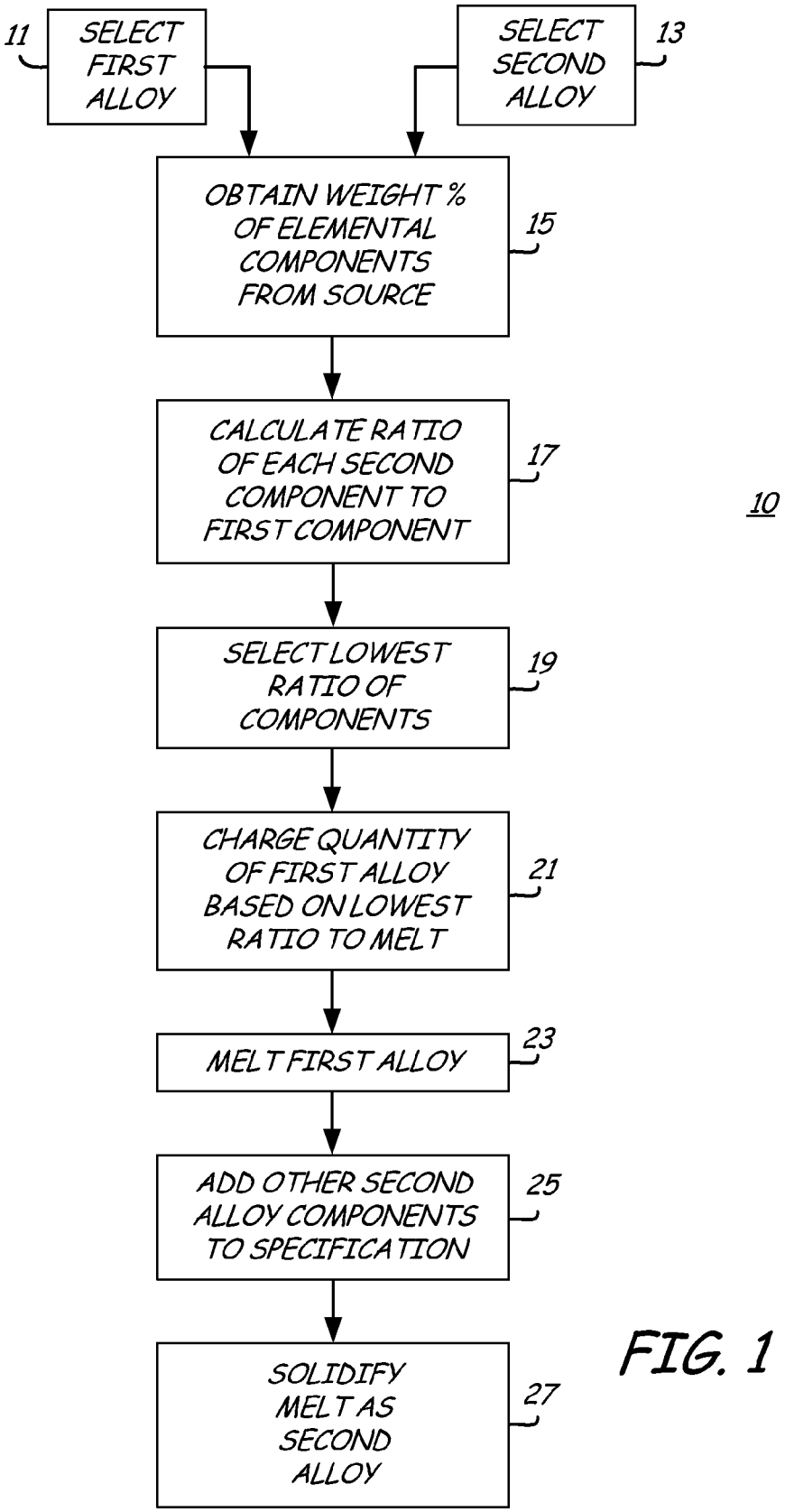
FIG. 1 is a diagram showing the process steps to convert a first alloy to a second alloy having a different composition of elements.

FIG. 1 illustrates method 10 of this invention which begins with selecting a first or revert alloy (step 11) and selecting a different second target alloy (step 13). Alloy manufacture requires knowledge of the elemental components of each different alloy that comply with a particular end user's chemistry specifications, often stored in a table or reference source or empirically determined. The input from the alloy selection process is used to consult a reference source (step 15) to obtain the weight percent of each elemental component for both alloys. Using this retrieved or stored data, the ratio of the weight percent of each component in the second target alloy to the weight percent of the same component in the first revert alloy is computed or otherwise determined (step 17) and stored, at least temporarily, until a record of the ingot is made. The lowest ratio of components is then selected (step 19) and that selection is used to determine how much of the first revert alloy is used.

Presented below in Table I are representations of an example of compositions of a revert alloy and a target alloy. The values for the constituent elements do not represent any actual alloy and are for illustration purposes only.

TABLE I

| Element | Weight % revert Alloy | Weight % Target Alloy | Ratio of Target/ Revert |
|---|---|---|---|
| Al | 5% | 6% | 100% |
| C | 0% | 1% | 100% |
| Co | 10% | 15% | 100% |
| Cr | 4% | 8% | 100% |
| Ni | 61% | 55% | 90.1% |
| Mo | 1% | 2% | 100% |
| W | 5% | 7% | 100% |
| B | 0.1% | 0.1% | 100% |
| Hf | 0% | 1% | 100% |
| Re | 2% | 2% | 100% |
| Ta | 8% | 4% | 50% |
| Zr | 0% | 0.1% | 100% |

As can be seen, most of the elemental constituents are present in the target alloy in at least the same weight percent as in the revert alloy. However, note that the amount of nickel in the target alloy is less than in the revert alloy, so the ratio is only 90.1%, and the amount of tantalum is only half, so the ratio is 50% for this constituent. Thus this ratio is selected, seen in FIG. 1, as the limiting ratio (step 19) to determine how much of the first alloy is charged to a furnace (step 21) and melted (step 23). The proper amounts of the other constituents are added to the melt (step 25) and the resulting melt, having the elemental constituents of the target alloy, is solidified. (step 27).

In every case, the amount of first or revert alloy that can be used to manufacture a second or target alloy is the elemental constituent that has the lowest ratio of weight percent target alloy to weight percent first alloy. This ensures that the resulting target alloy does not have any elemental constituent that exceeds the desired, or a maximum amount allowed in the specification for that target alloy.

Figure 2:
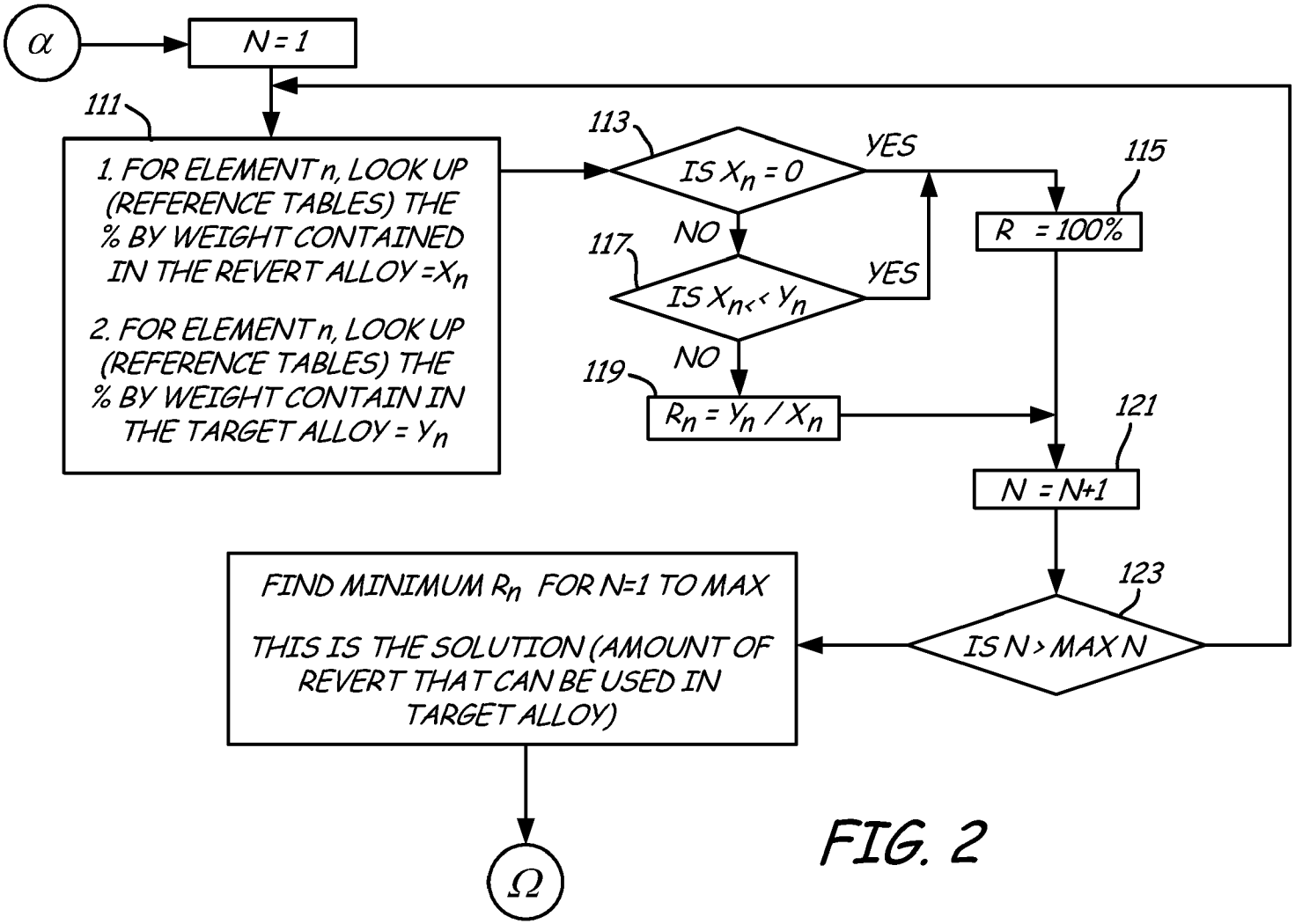
FIG. 2 is a diagram showing the steps used by the process of FIG. 1.

One method for making the determination of selecting the amount of first alloy to melt (step 19) is shown in FIG. 2. Beginning at $\alpha$, N represents the number of constituent elements and data for each of them (for example, the twelve elements in Table I) are obtained as $X_n$ and $Y_n$ from reference tables (box 111) and transmitted to a first decision point (box 113). If $X_n$=0, 100% of that element (box 115) from the revert alloy $R_n$ can be used. If $X_n$ is not=0, it is compared to $Y_n$ (box 117) and if it is less, once again 100% of that constituent element can be used. If $X_n$ is not less than $Y_n$ the ratio of $X_n/X_n$ is calculated, as R, (box 119) and that number is transmitted to storage (box 121) as are all the values for R, for each elemental constituent. If N is greater than Max N, which is the number of elemental constituents, the process is repeated (box 123) returning to obtain $X_{n+1}$ and so on. Once all the data has been obtained, the elemental constituents are analyzed and the lowest value (step 19) is selected and that quantity (step 21) is charged to the furnace (box Ω).

Figure 3:
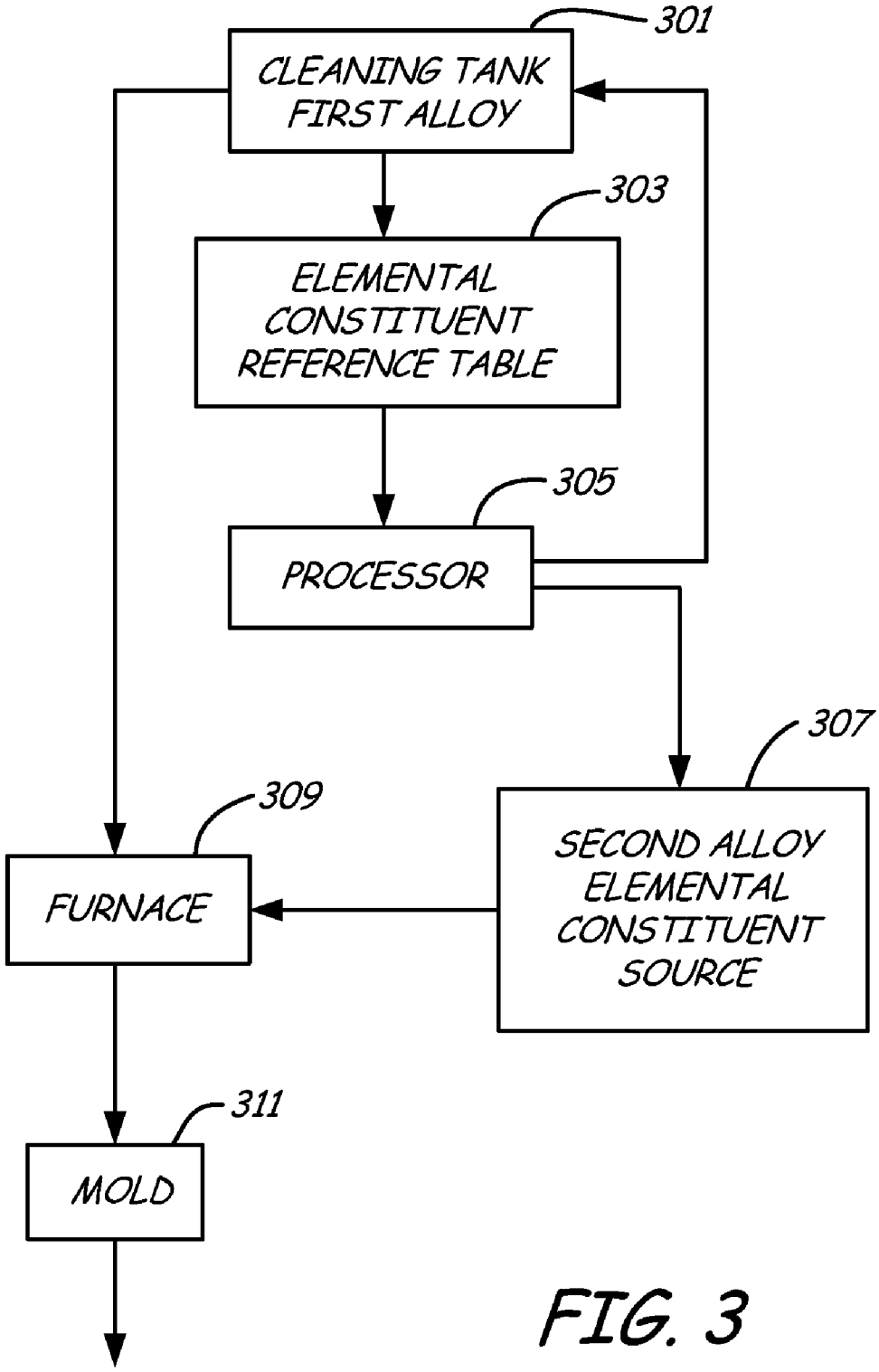
FIG. 3 is a diagram showing the system used in FIG. 1.

FIG. 3 illustrates the system used in FIG. 1. Cleaning tanks 301 are used to prepare the revert alloy for use. An elemental constituent reference table 303 is consulted and the values for both the revert alloy and the target alloy are inputted into processor 305, which determines the amount of the revert alloy to be sent to furnace 309, for example 50% by weight based on the data in Table I. Processor 305 also informs the source of the second target alloy elemental constituents 307 how much of each constituent is to be added to furnace 309. Once the target alloy is molten, it is solidified in mold 311.

A wide variety of first alloys can be used in accordance with this invention to prepare second alloys having different elemental constituents, wherein the assigned quantity of first or revert alloy with the lowest ratio as described above can be added to a furnace and additional elemental constituents then added to form a melt of the second or target alloy. Casting the second or target alloy into solid form completes the process. This demonstrates that scrap alloys have increased value because they can be used in the manufacture of other alloys. More effective use of scrap alloys makes the manufacturing process more commercially economical.

Although the present invention has been described with reference to preferred embodiments, workers skilled in the art will recognize that changes may be made in form and detail without departing from the spirit and scope of the invention.

The invention claimed is:

1. A method of using a first alloy having a first composition in the manufacture of a second alloy of a second composition, the method comprising:

identifying the first alloy having a plurality of constituents;

identifying the second alloy having a plurality of constituents;

obtaining a percentage by weight of all the elemental constituents of the first alloy and of the second alloy from a data base;

calculating a ratio of a percentage by weight of each elemental constituent in the second alloy to a percentage by weight of a corresponding elemental constituent in the first alloy;

determining which elemental constituent ratio is lowest;

taking the lowest constituent ratio to select an amount of the first alloy so that the same amount of that constituent is in both alloys;

melting the selected amount of the first alloy to form a melt;

adding additional quantities of elemental constituents to the melt so that the melt has the second composition of the second alloy; and solidifying the melt to form the second alloy.

2. The method of claim 1, wherein the first alloy is a revert alloy and the second alloy is a target alloy.

3. The method of claim 1, wherein the weight percent of each of the elemental constituents is obtained from a reference table.

4. The method of claim 1, wherein the first and second alloys are super alloys having different elemental constituents.

5. The method of claim 1, wherein the calculating the ratio comprises:

(a) determining if an amount of each elemental constituent of the second alloy is present in the first alloy;

(b) assigning a ratio of 100% if the constituent is not present in the first alloy, or is present in a lower percentage by weight in the first alloy than in the second alloy;

(c) determining the element constituent ratio for each constituent that is present in a greater percentage in the first alloy than in the second alloy by dividing the percentage of the constituent in the first alloy by percentage of the constituent in the second alloy;

(d) continuing to calculate a ratio for each elemental constituent using steps (a) through (c) above.

6. The method of claim 5, wherein the first alloy is a revert alloy, the second alloy is a target alloy, and the weight percent of each of the elemental constituents is obtained from a reference table.

* * * * *